United States Patent [19]

Gaudreau

[11] Patent Number: 4,719,897

[45] Date of Patent: Jan. 19, 1988

[54] COCKING MECHANISM FOR CROSSBOW

[76] Inventor: Jacques Gaudreau, 7265 Lacordaire #38, Montreal, Quebec, Canada, H1S2A5

[21] Appl. No.: 855,386

[22] Filed: Apr. 24, 1986

[51] Int. Cl.[4] ..... F41B 5/00

[52] U.S. Cl. ..... 124/25; 124/35 R

[58] Field of Search ..... 124/25, 31, 37, 35 R, 124/22, 21, 35 A, 24 R, 23 R, 80, 16, 26

[56] References Cited

U.S. PATENT DOCUMENTS

| | | | |
|---|---|---|---|
| 1,434,768 | 11/1922 | Boggess | 124/16 |
| 1,846,157 | 2/1932 | Stevens | 124/25 |
| 2,786,461 | 3/1957 | Pelsue, Jr. | 124/25 |
| 3,125,998 | 3/1964 | Stevens | 124/25 |
| 3,509,863 | 5/1970 | Barker | 124/31 |
| 3,538,901 | 11/1970 | Switack | 124/35 R |
| 3,670,711 | 6/1972 | Firestone | 124/35 R |
| 3,967,609 | 7/1976 | Frydenlund | 124/24 R |
| 4,192,281 | 3/1980 | King | 124/25 |
| 4,365,611 | 12/1982 | Nishioka | 124/24 R |

FOREIGN PATENT DOCUMENTS

| | | | |
|---|---|---|---|
| 130729 | 12/1932 | Fed. Rep. of Germany | 124/25 |

*Primary Examiner*—Kenneth J. Dorner
*Assistant Examiner*—Peter M. Cuomo
*Attorney, Agent, or Firm*—Schwartz, Jeffery Schwaab, Mack, Blumenthal & Evans

[57] ABSTRACT

The crossbow has an elongated frame formed at one end with a stock containing a triggering mechanism including a trigger and a latch. The other end of the crossbow is a barrel which includes a slide to mount an arrow. A bow and string combination is disposed on the barrel at the front part thereof to be associated with the slide. The cocking mechanism comprises a sliding channel formed in the barrel, whose rearward end extends to the triggering mechanism and is in open communication therewith. A string engaging member is slidably disposed in the channel and has a hooking device thereon to engage the string. The string engaging member is arranged to engage the string while the latter is in released position and to slide in the channel with the string hooked thereto until the latter is in cocked position and becomes engaged by the latch. A spring or the like then retracts the string engaging member at the forward end of the channel. This cocking mechanism requires less strength to operate than other known devices and is much easier and cheaper to manufacture.

11 Claims, 12 Drawing Figures

COCKING MECHANISM FOR CROSSBOW

BACKGROUND OF INVENTION

1. Field of the Invention

This invention relates to a cocking mechanism for a crossbow. More particularly, the present invention is concerned with an improved crossbow provided with a cocking device which is easier to operate than other known devices, in that it requires less strength.

2. Description of the Prior Art

Crossbows have been known for a long time and they still constitute a piece of sporting equipment which is favored by many people. However, like everything else, the trend is to produce a device which is attractive and as easy as possible to operate by the vast majority of people.

In the early days, crossbows were cocked manually. To do this, the string was grasped with the fingers of both hands to be thereafter engaged by the trigger mechanism. Of course, this limited greatly the use of a crossbow, mainly because a normal person does not always have enough strength to achieve sufficient cocking to enable the crossbow to produce all the energy that could be expected of such a piece of equipment.

To obviate this difficulty, especially when the crossbow was used by the military, mechanical cocking devices were designed which were nearly all cumbersome, expensive, complicated to manufacture and operate and also time consuming.

The prior art is loaded with such cocking devices which have the disadvantages mentioned above. The following patents are pertinent:

| | | | |
|---|---|---|---|
| German | 56,828 | June 6, 1891 | Heynemann et al |
| U.S. | 2,092,361 | September 7, 1937 | Shirm |
| U.S. | 3,028,851 | April 10, 1962 | Drake |
| U.S. | 3,043,287 | July 10, 1962 | Nelson |
| U.S. | 3,538,901 | November 10, 1970 | Switack |
| U.S. | 3,670,711 | June 20, 1972 | Firestone |
| U.S. | 3,783,852 | January 8, 1974 | Shepherd |
| U.S. | 3,968,783 | July 13, 1976 | Pftenhauer |
| U.S. | 4,258,689 | March 31, 1981 | Barnett |

SUMMARY OF INVENTION

It is an object of the present invention to provide a cocking mechanism for a crossbow, which is easy to operate and requires little strength.

It is another object of the present invention to provide a cocking device which is not bulky and can easily be integrated within the body of the crossbow.

It is another object of the present invention to provide a cocking mechanism which, because of its ease of manufacture, makes it highly economical.

It is another object of the invention to provide a cocking mechanism which, because of its ease of manipulation, enables the crossbow to be cocked to a maximum value without exercising much strength.

In accordance with the present invention, there is provided a cocking mechanism for a crossbow, the crossbow including an elongated frame formed at one end with a stock containing a triggering mechanism including a trigger and a latch member, and a barrel member at the other end. The barrel member includes a slide to mount an arrow, and a bow and string combination disposed on the barrel at the front part thereof and associated with the slide. The cocking mechanism comprises a sliding channel formed in the barrel, the sliding channel having a forward end and rearward end, the rearward end extending to the triggering mechanism in open communication therewith, a string engaging member slidably disposed in the channel, the string engaging member having hooking means thereon to engage the string, means to cause the string engaging member to engage the string by means of the hooking means while the string is in released position and to cause sliding of the string engaging member along the sliding channel until the string engaging member reaches the triggering mechanism and the string is in cocked position and becomes engaged by the latch member, and resilient means connected to the string engaging member to retract the latter to the forward end of the channel after the string has been engaged by the latch.

BRIEF DESCRIPTION OF THE DRAWINGS

The invention is illustrated, without being limited thereto, by means of the following drawings, in which.

DESCRIPTION OF THE PREFERRED EMBODIMENTS

Figure 1:
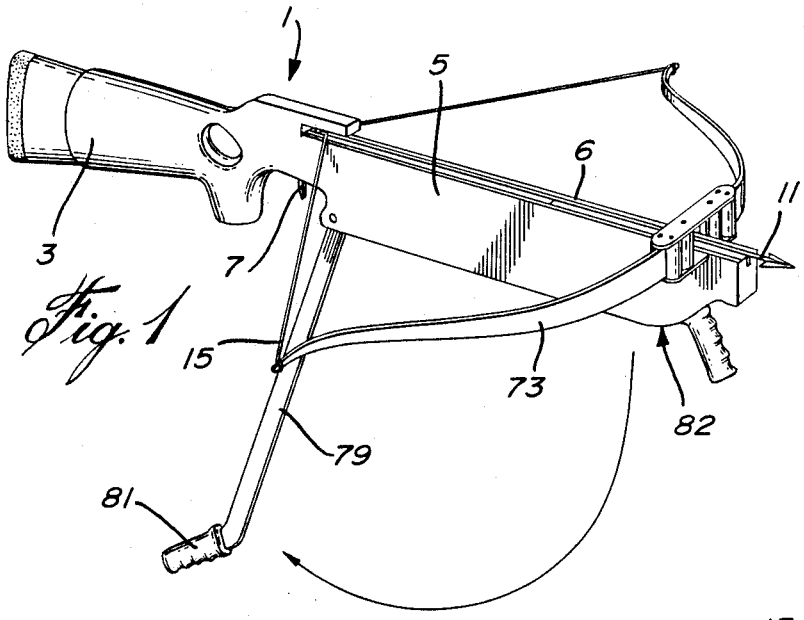
FIG. 1 is a perspective view of a crossbow provided with a cocking mechanism according to an embodiment of the invention.

Referring to the drawings, there is illustrated a crossbow 1 of generally standard construction. For example, the crossbow 1 includes, as shown, an elongated frame which is formed of two main parts, namely a stock 3 at one end and a barrel member 5 at the other end. The stock 3 contains a triggering mechanism of which only the trigger 7 appears in FIGS. 1 to 4. Latch 9 will best be seen in FIGS. 6 to 8. The barrel member 5 includes a slide 6 to mount arrow 11, and a bow 13 and string 15 combination, the latter being disposed on the barrel 5 at the front part thereof, as particularly shown in FIG. 1.

Figure 2:
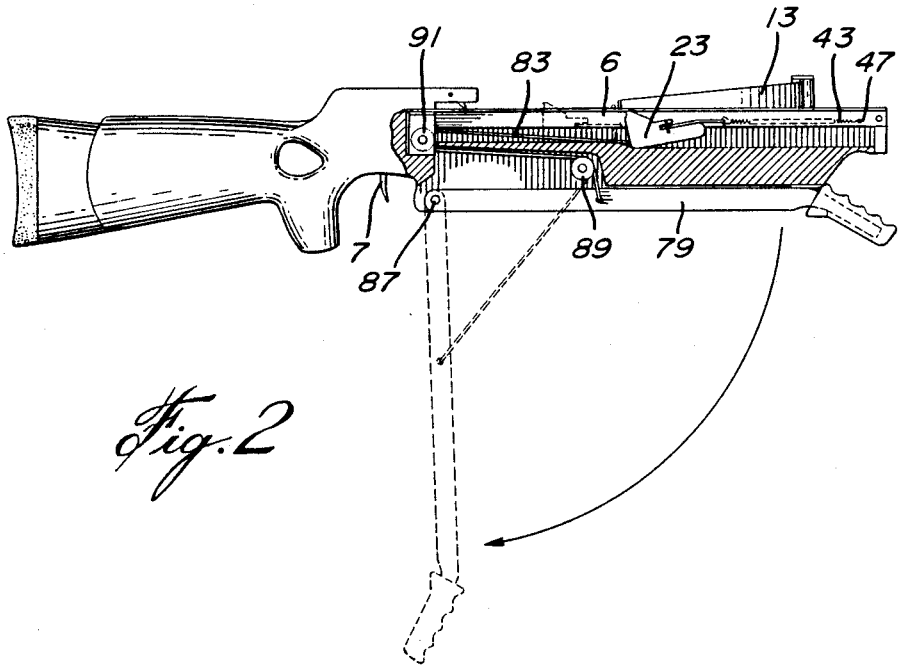
FIG. 2 is a side view of the same crossbow with the barrel being partly opened and showing details of a cocking mechanism according to the same embodiment of the invention.
Figure 3:
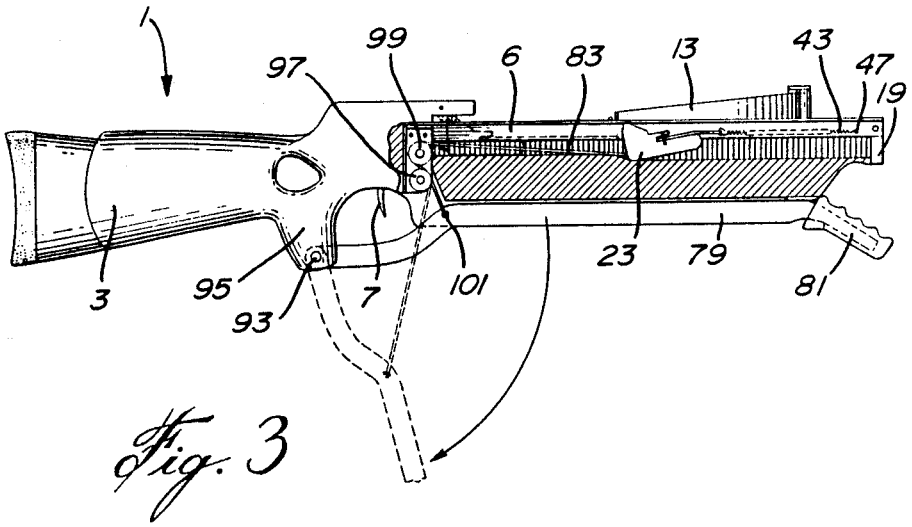
FIG. 3 is a view similar to FIG. 2 showing another embodiment.

The cocking mechanism per se is generally shown in FIGS. 1 to 3 while details are particularly illustrated in FIGS. 5 to 9. Formed inside the barrel member 5, there is a sliding channel 17 which is better shown in FIG. 5. Also as shown, the channel 17 is closed at its forward end 19 and it extends all the way to the triggering mechanism formed by the trigger 7 and the latch 9, where it is in open communication therewith as particularly shown in FIGS. 7 and 8. In the embodiment illustrated, the channel 17 is rectangular, although any other suitable shape or configuration could be used provided it will enable the cocking mechanism to operate.

The cocking mechanism comprises as an essential element, a string engaging member which is in the form of a U-shaped device 23 having a flat bottom 25 and two outer upstanding walls 27 (only one being shown in FIG. 5) and both being parallel to one another. In addition, it will be seen that each upstanding wall 27 has a partial extension 31, as particularly shown in FIG. 5. In the embodiment illustrated, the extensions 31 are somewhat trapezoidal and each includes a front edge 33 and a rear edge 35. A hook 37 is formed near the upper end of the front edge 33, and faces the rearward end of the channel 17. Of course each hook must be capable of engagement with the string 15.

Figure 5:
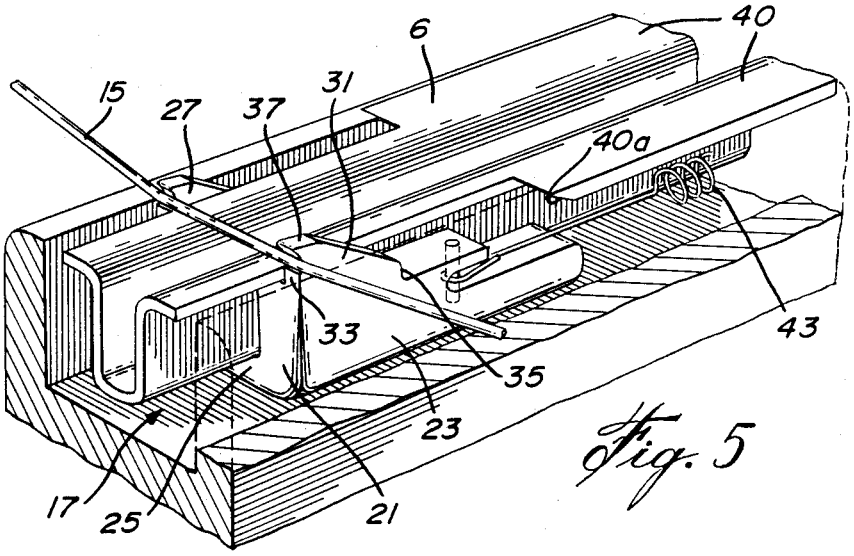
FIG. 5 is a perspective view showing the string engaging member disposed in a sliding channel and also incorporating the slide for the arrow.
Figure 6:
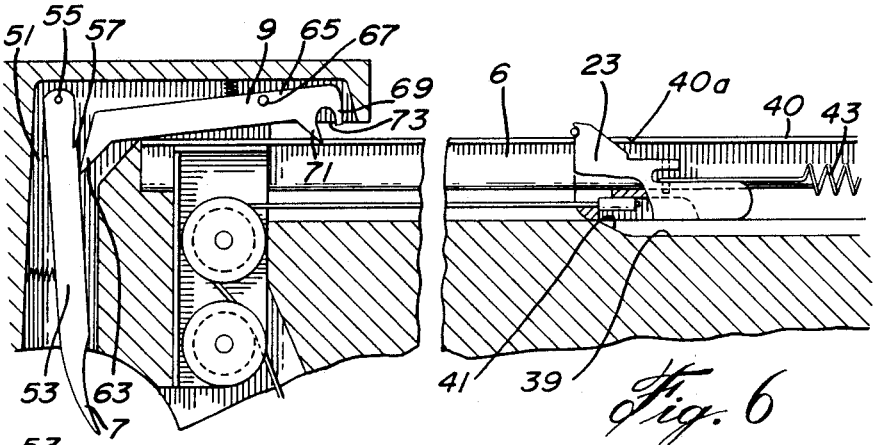
FIG. 6 is a cross-section view showing the string engaging member in cocking position.
Figure 7:
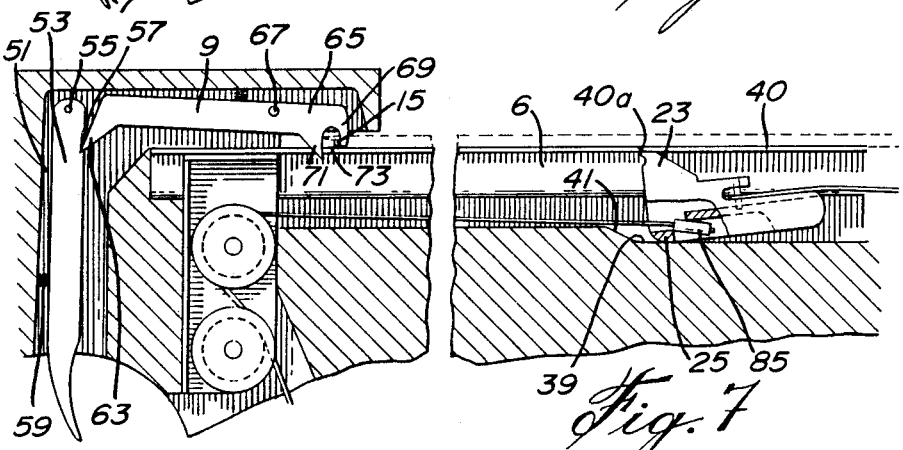
FIG. 7 is a cross-section view showing the triggering mechanism in position for shooting an arrow with the string engaging member in retracted position.

As particularly shown in FIGS. 6 and 7, the rectangular channel 17 has a depression 39 formed therein at its forward end. The reason for this depression is that when the U-shaped device 23 is at the forward end of the channel 17, it can sit into the depression 39 at a lower level (as shown in FIG. 7) than when it slides in the channel 17 toward the triggering mechanism. While occupying this position in the depression 39, it is obvious that the U-shaped device 23 including hooks 37 will be prevented from obstructing the trajectory of the arrow 11 as it travels above the U-shaped device 23 upon being released by the triggering mechanism. This is all clearly illustrated in FIGS. 5 to 7. As particularly shown therein, it will be seen that the slide 6 has a pair of flanges 40 near the forward end of the channel 17, which terminate as an upwardly inclined step 40*a* enabling the U-shaped device 23 to raise to the hooking position illustrated in FIG. 6, with the help of the ramp 41 formed at the bottom of the channel 17 at the end of depression 39, all as shown in the drawings.

It will be explained below that cocking of the crossbow 1 pulls the U-shaped device 23 toward the triggering mechanism by sliding along channel 17. In so doing, the U-shaped device 23 will ride up ramp 41 to occupy the position illustrated in FIG. 6 where the hooks 37 can engage the string 15 as shown in FIG. 5.

To complete the U-shaped device 23, it must be mentioned that a spring 43 is provided for each partial extension 31. Each spring 43 is connected at 47 at the forward end 19 of the sliding channel and at 49 of the corresponding partial extension 31. When no force is exerted on the U-shaped device 23, the springs 43 will cause their retraction to a position illustrated in FIG. 7.

For a better understanding of the invention, we shall now describe the triggering mechanism. As in a well known crossbow a recess 51 is formed in the stock 3 to receive the triggering mechanism. As mentioned above, the triggering mechanism comprises a trigger 7 and a latch 9. With particular reference to FIGS. 6 to 9, it will be seen that the trigger 7 essentially comprises a pivot member 53 which is articulated at 55 at one end thereof and is also formed with a catch 57. A spring 59 is disposed between the pivot member 53 and the wall of the recess 51, more particularly inside cavity 61. This spring 59 will urge the trigger 7 into engagement with the latch 9 by receiving the tip 63 of the latch into catch 57.

Figure 9:
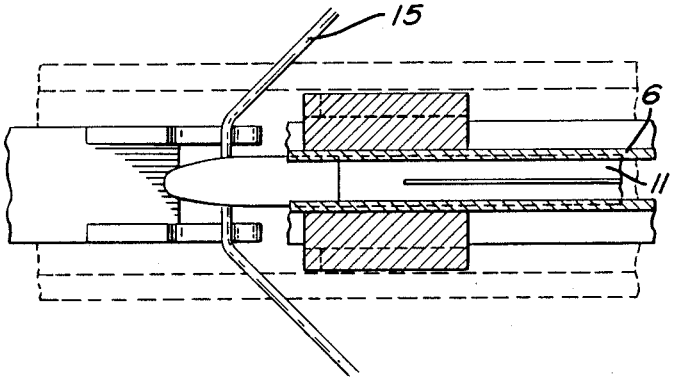
FIG. 9 is a top plan view showing the latch, and an arrow in the slide, in cocked position of the string.
Figure 10:
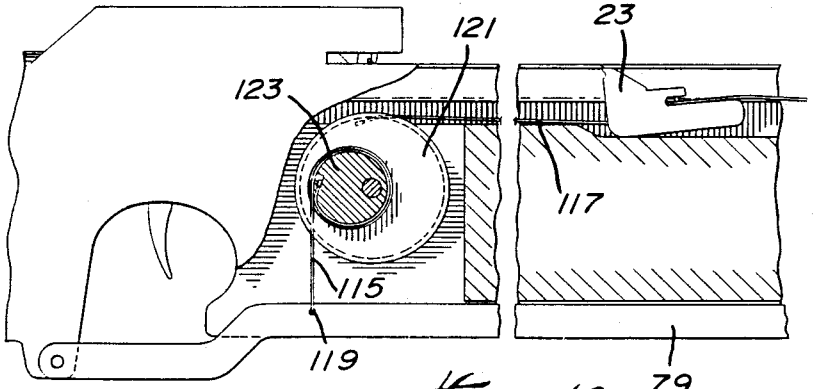
FIG. 10 is a side view of a crossbow according to the invention showing details of yet another cocking mechanism.

The latch 9 comprises a pivot member 65 of a different shape, as particularly shown in FIGS. 9 and 10. The pivot member 65 is articulated at 67 near one end thereof. As mentioned above, the pivot member 65 is formed with a tip 63 at its other end, to be engaged by the catch 57. As shown, the end of the pivot member 65 near articulation 67 is provided with a wing member 69 and a second wing member 71, both defining a jaw 73 therebetween. A spring 75 is disposed between pivot member 65 and the upper wall of the recess 51, more particularly inside cavity 77. This spring 75 will urge the latch in releasing the string upon acting on the trigger 7.

The purpose of both wing members 69 and 71 and jaw 73 will now be described. When the string is cocked to its full extent, as will be more fully explained later, the string engaging member constituted by the U-shaped device 23, with the string 15 hooked onto itself will move toward the latch 9 as shown in FIG. 6 to finally engage the string 15 as shown in FIG. 7. As it moves further toward the latch 9, the string engaging member 23 will ride underneath wing member 69 and will thereafter hit upon wing member 71. This will cause the latch 9 to pivot into the position illustrated in FIG. 7. Simultaneously, wing member 69 will engage the string 15 as shown in FIG. 7, which is the cocked position of the crossbow.

Reference will now be had to FIGS. 1 to 4 and 10 to 12 of the drawings for a better understanding of the cocking mechanism. It will be seen that the mechanism comprises a cocking lever 79 which is pivoted rearwardly of the barrel 5. A handle 81 is provided at the opposite end of the cocking lever 79 and a lower channel 82 is provided along the underface of the barrel 5 to receive the cocking lever 79 while the latter is in non-operative position. A cable 83 operatively connects the U-shaped device 23 to the cocking lever and a system of pulleys is used for winding the cable when cocking the lever 83. As shown in FIG. 7, the cable is attached at 85 to the flat bottom 25 of the U-shaped device 23.

In the embodiment illustrated in FIG. 2, the cocking lever 79 is pivoted at 87 at the rear end of the barrel 5. The end of the cable 83 attached to the lever 79 is fixed at one point between the end of the lever 79 provided with the handle and the end which is articulated. As shown, the cable winds around two freely rotatable pulleys 89 and 91. It will be seen that pulley 89 is mounted on the barrel at a lower level and opposite the point where the cable is fixed to the cocking lever 79. On the other hand, pulley 91 is mounted in the barrel 5 at a higher level and opposite the trigger mechanism. In this manner, from its point of fixation on the cocking lever 79, the cable 83 winds around pulley 89, then around pulley 91 and is thereafter directed toward the U-shaped device 23 where it is attached to its flat bottom 25.

Figure 4:
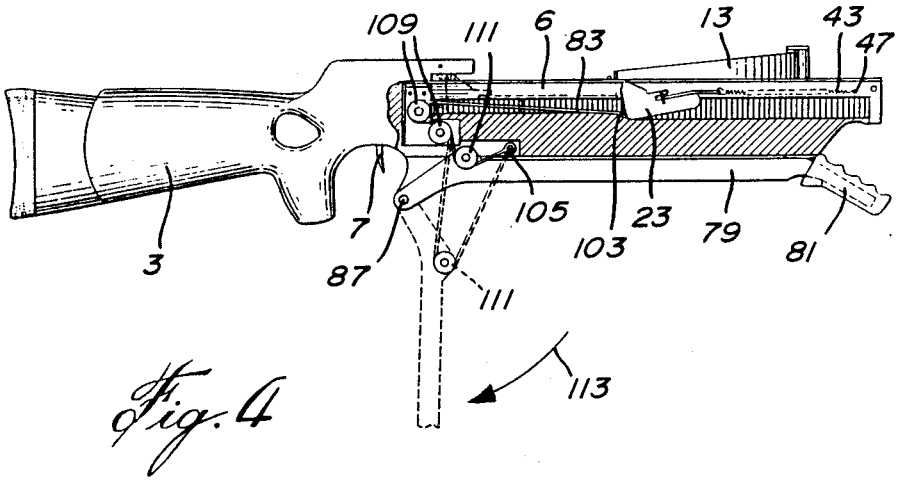
FIG. 4 is a view similar to FIG. 2 showing yet another embodiment.

Turning now to the embodiment illustrated in FIG. 3, it will be seen that contrary to the embodiments illustrated in FIGS. 2 and 4 where the cocking lever 79 is pivoted at the rear end of the barrel, in this case the cocking lever is pivoted at 93 on the grip 95 of the stock 3 rearwardly of the triggering mechanism. As in the previous case, the cable 83 is attached to the flat bottom 25 of the U-shaped device 23 and also on the cocking lever 79 at one point intermediate between the handle 81 and pivot 93. There are provided two freely pivotable pulleys 97 and 99. Pulley 97 is mounted in known manner on the barrel member 5 at a lower level and opposite the point of attachment 101 of the cable 83 on the cocking lever 79. Freely pivotable pulley 99, on the other hand, is mounted, also in known manner, on barrel member 5 at a higher level, as shown, and above pulley 97. In this manner, cable 83 will extend from point of attachment 101 to be wound first around pulley 97 to thereafter be directed toward pulley 99 around which it winds, after which it is directed toward the string engaging member 23.

We shall now describe the embodiment illustrated in FIG. 4 of the drawings. It will be noted first that the cocking lever 79 is identical to and similarly mounted as the cocking lever for the embodiment of FIG. 2. However, in this case, the cable 83, while being similarly attached at 103 to the flat bottom 5 of the U-shaped device 23, has its other end interiorly fixed to the barrel member 5 at 105. In this embodiment, the cable 83 winds around three freely rotatable pulleys 107, 109 and 111. Pulley 107 is mounted interiorly of the barrel member 5 at a lower level and ahead of pivot point 87 where the end of the cocking lever 79 is pivoted at the rear end of the barrel. Pulley 109, on the other hand, is also mounted in known manner interiorly of the barrel member 5 at a higher level than pulley 107 and opposite and closer to the trigger mechanism. Finally, the third pulley 111 is mounted on the cocking lever 79 ahead of the pulleys 107 and 109, as shown in FIG. 4, so that the cable winds around the three pulleys 107, 109 and 111. When the cocking lever 79 is pulled down in the direction of arrow 13, as shown in FIG. 4, the string engaging member 23 hooks into string 15 to bring it into cocking position.

Figure 12:
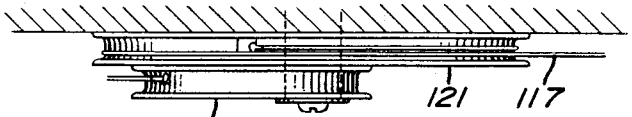
FIG. 12 is a view showing two pulleys used in the cocking mechanism of FIGS. 10 and 11.
Figure 11:
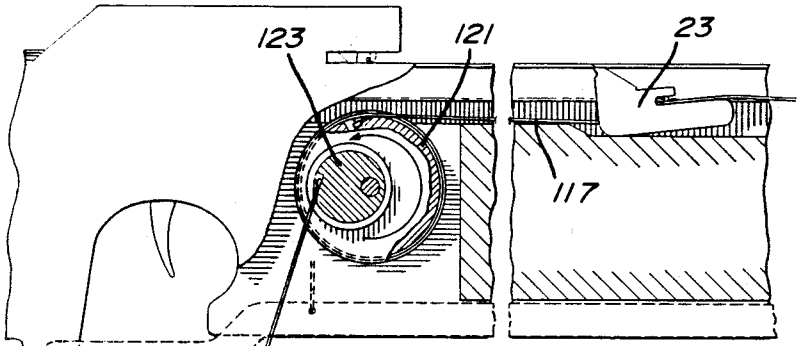
FIG. 11 is a view similar to FIG. 10 showing the cocking mechanism in extended position.

Another embodiment is illustrated in FIGS. 10 to 12 of the drawings. In this embodiment, the cable is made of two parts 115, 117. One end of part 115 is attached at a point 119 intermediate the handle 81 and the pivot point 93, and the attachment of the other end of part 115 will be described later. With respect to part 117, it will be seen that it has one of its ends attached at 119 to the U-shaped device while its other end has a special attachment which will be described later.

Figure 8:
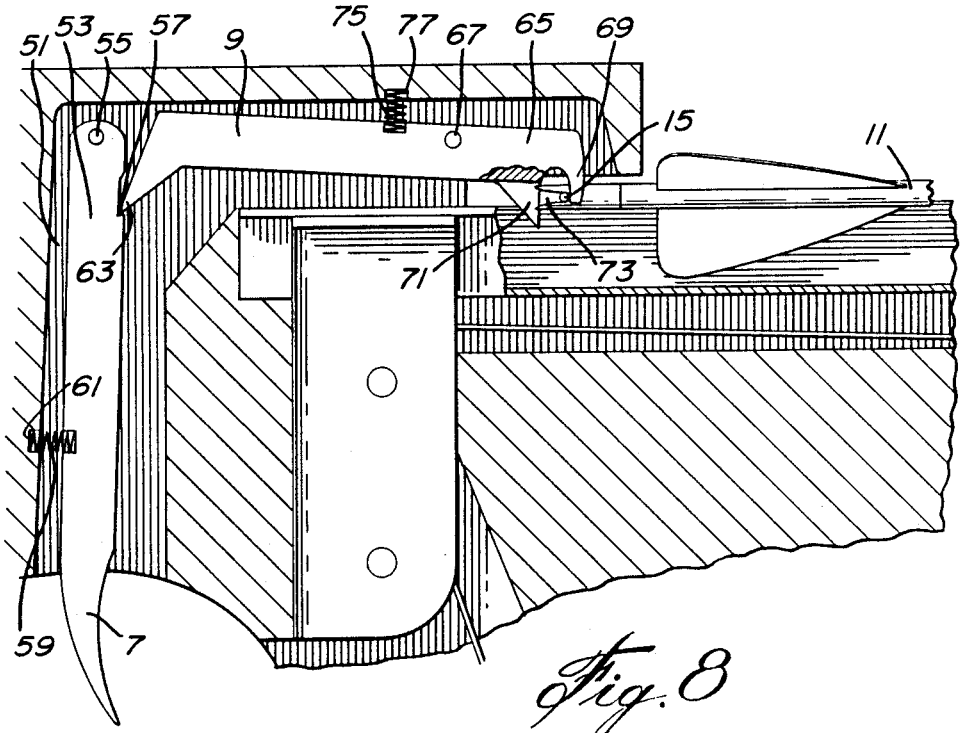
FIG. 8 is a cross-section view showing the trigger mechanism after cocking of the string with an arrow ready to be projected.

This embodiment also includes a special type of pulley combination made of pulley 121 and pulley 123. Pulley 121 is freely rotatable and is mounted in barrel member 5 at a higher level and just about opposite attachment point 119 where part 115 is attached to the handle 79. The other end of cable part 117 is attached in known manner, as shown in FIGS. 10 to 12 of the drawings, at 125 inside the score of pulley 121 and is wound around it as shown. The pulley combination includes a second pulley 123 of smaller radius than pulley 121 which is fixed in known manner parallel to the pulley 121 but has its centre offset with respect to the centre of pulley 121. In other words, pulley 123 is eccentrically fixed to pulley 121. The other end of cable part 115 is attached in known manner, as shown in FIGS. 10 to 12 of the drawings, at 127 inside the score of pulley 123 and is wound around it as shown. It will be realized that rotation of pulley 121 will cause an eccentric or leverage rotation of pulley 123. The result is that when cocking the crossbow by downwardly pulling on the cocking lever 79 cable part 115 will cause an eccentric rotation of pulley 121, but because of the leverage effect, the force required on the cocking lever 79 will be substantially less. In fully opened position of the cocking lever the two pulleys 121 and 123 and cable parts 115 and 117 are as shown in FIG. 11 and the crossbow is then in cocked position The operation of the cocking mechanism according to the invention is quite simple. It is merely necessary to pull down the cocking lever 79 and in accordance with all the embodiments illustrated and described, the string engaging member 23 will hook into the string 15 in released position to cock the latter by engaging it behind wing member 69 of the latch 9. An arrow is thereafter positioned as shown in FIGS. 8 and 9 in slide 6 and is then ready to be projected by acting on the trigger. As soon as the string 15 has been cocked as shown in FIGS. 8 and 9, the string engaging member 23 is retracted by means of the springs 43 which cause the string engaging member 23 to slide along channel 17 until it reaches the position illustrated in dotted lines in FIGS. 3 and 4.

I claim:

1. A cocking mechanism for a crossbow, said crossbow including an elongated frame formed at one end with a stock containing a triggering mechanism including a trigger and a latch member and a barrel member at the other end, said barrel having a front part and a rear part, said barrel member including a slide to mount an arrow, and a bow and string combination disposed on said barrel at the front part thereof and associated with said slide, said cocking mechanism comprising a sliding channel formed in said barrel, said sliding channel being rectangular and having a forward end and a rearward end, said rearward end extending to said triggering mechanism in open communication therewith, a string engaging member slidably disposed in said channel, said string engaging member comprises a U-shaped device having a flat bottom and upstanding side walls, each upstanding side wall formed with a hook near the upper end thereof facing said rearward end of said channel, said hook being engageable with said string, said rectangular channel having a depression formed therein at said forward end thereof so that when said U-shaped device is at the forward end of said rectangular channel it sits therein at a lower level than when it slides in said channel toward said triggeringmechanism, thereby preventing said U-shaped device including said hooks from obstructing said arrow upon release thereof, said slide is disposed in said channel, said U-shaped device is adapted to travel between the bottom of said channel and said slide, said slide comprising a pair of flanges at the forward end of said channel, said flanges terminating in upwardly inclined steps, an inclined ramp formed in said channel to connect said depression to the bottom of said channel so that when pulling said U-shaped device toward said triggering mechanism, said U-shaped device will rise by riding on said ramp and said hooks will rest against said flanges until reaching said upwardly inclined steps when they engage said string, 2. A cocking mechanism according to claim 1, which comprises a recess formed in said stock to receive said triggering mechanism, said trigger comprising a first pivot member articulated at one end thereof and formed with a catch, and a first spring member disposed between said pivot member and the wall of said recess to urge said trigger in engagement with said latch by means of said catch, said latch comprising a second pivot member articulated near one end thereof, said second pivot member formed with a tip at the other end thereof to be engaged by said catch, said one end of said second pivot member being formed with a first wing member and a second wing member, both defining a jaw, and a second spring member disposed between said second pivot member and the wall of said recess to urge said latch in releasing said string upon acting on said trigger, said first wing member adapted to engage said string in cocked position thereof and said second wing member adapted to cause articulation of said second pivot member upon being forced by said string engaging member, so that said tip becomes engaged by said catch.

3. A cooking mechanism according to claim 1, wherein each said upstanding wall is formed with a partial extension having a front edge and a rear edge, said hook being formed on said rear edge, a spring provided for each partial extension, each spring being connected between the forward end of said sliding channel and the front edge of said partial extension, said springs to constitute said resilient means.

4. A cocking mechanism according to claim 1, which comprises a cocking lever pivoted at one end rearwardly of said barrel and disposed therebelow, a handle at the opposite end of said cocking lever and a lower channel to receive said cocking lever in non-operative position of the latter, a cable operatively connecting said U-shaped device to said cocking lever, and pulley means for winding said cable when cocking said lever.

5. A cocking mechanism according to claim 4, wherein said cable is attached to said flat bottom of said U-shaped device.

6. A cocking mechanism according to claim 4, wherein said cocking lever is pivoted at said one end at the rear end of said barrel.

7. A cocking mechanism according to claim 6, wherein said cable is attached at one end on said cocking lever at one point between said one end and said handle, said cable being attached at the other end on said U-shaped device, said cable winding around two freely rotatable pulleys, one pulley being mounted in said barrel at a lower level and opposite said one point of said cocking lever, a second pulley being mounted in said barrel at a higher level and opposite said trigger mechanism, so that said cable from said one point first winds around said one pulley to thereafter be directed towards said second pulley and wind around same, after which it is directed toward said string engaging member.

8. A cocking mechanism according to claim 6, wherein said cable is attached at one end on said barrel interiorly thereof and at the other end to said flat bottom of said U-shaped device, said cable winding around three freely rotatable pulleys, one pulley being mounted in said barrel at a lower level and ahead of a point where said one end of said cocking lever is pivoted at the rear end of said barrel, a second pulley mounted in said barrel at a higher level and opposite and closer to said trigger mechanism, a third pulley mounted on said cocking lever ahead of said first and second pulleys so that said cable winds around said three pulleys and when said cocking lever is pulled down said string engaging member hooks into said string to bring the latter into cocking position.

9. A cocking mechanism according to claim 4, wherein said cocking lever is pivoted at said one end on said stock rearwardly of said triggering mechanism.

10. A cocking mechanism according to claim 9, wherein said cable is attached at one end on said cocking lever at one point between said one end and said handle, said cable being attached at the other end on said U-shaped device, said cable winding around two freely rotatable pulleys, one pulley being mounted in said barrel at a lower level and opposite said one point of said cocking lever, a second pulley being mounted in said barrel at a higher level and above said first pulley, so that said cable from said one point first winds around said first pulley to thereafter be directed toward said second pulley and wind around same, after which it is directed toward said string engaging member.

11. A cocking mechanism according to claim 9, wherein said cable comprises a first part and a second part, said first part being attached at one end on said cocking lever at one point between said one end of said cocking lever and said handle, said second part being attached at one end on said U-shaped device, a first freely rotatable pulley mounted in said barrel at a higher level and opposite point of attachment of said first part on said cocking lever, a second pulley of smaller radius than said first freely rotatable pulley, said second pulley being eccentrically fixed to said first pulley, the other end of said first cable part being attached to said second pulley to wind therearound, and the other end of said second cable part being attached to said first pulley to wind therearound, so that when cocking said lever, said first cable part will cause leverage rotation of said second pulley as a result of the fact that it is eccentrically mounted on said first pulley to rotate said first pulley and draw said U-shaped device toward said triggering mechanism until said crossbow is cocked.

* * * * *